United States Patent [19]

Asano et al.

[11] Patent Number: 4,648,918

[45] Date of Patent: Mar. 10, 1987

[54] ABRASION RESISTANT ALUMINUM ALLOY

[75] Inventors: Kazuhiko Asano; Osamu Takezoe; Yoshinori Yasuda; Kenji Hayashi; Masanobu Aoki; Yoshio Doi; Makoto Shimata, all of Yamaguchi, Japan

[73] Assignee: Kabushiki Kaisha Kobe Seiko Sho, Kobe, Japan

[21] Appl. No.: 647,397

[22] Filed: Sep. 5, 1984

[30] Foreign Application Priority Data

| | | | |
|---|---|---|---|
| Mar. 2, 1984 | [JP] | Japan | 59-40145 |
| Mar. 19, 1984 | [JP] | Japan | 59-53158 |
| Mar. 26, 1984 | [JP] | Japan | 59-57588 |

[51] Int. Cl.[4] ..... C22C 21/02

[52] U.S. Cl. ..... 148/439; 148/2; 148/11.5 A; 148/12.7 A; 148/417; 148/418

[58] Field of Search ..... 148/439, 417, 418, 2, 148/11.5 A, 12.7 A; 420/532, 534, 535, 536

[56] References Cited

U.S. PATENT DOCUMENTS

| | | | |
|---|---|---|---|
| 3,868,250 | 2/1975 | Zimmermann | 148/439 |
| 4,077,810 | 3/1978 | Ohuchi et al. | 148/439 |
| 4,432,313 | 2/1984 | Matlock | 420/532 |
| 4,434,014 | 2/1984 | Smith | 148/417 |

*Primary Examiner*—R. Dean

*Attorney, Agent, or Firm*—Oblon, Fisher, Spivak, McClelland & Maier

[57] ABSTRACT

An abrasion resistant aluminum alloy characterized in that the aluminum alloy has a chemical composition basically containing 7.5–15 wt % of Si, 3.0–6.0 wt % of Cu, 0.3–1.0 wt % of Mg, 0.25–1.0 wt % of Fe, 0.25–1.0 wt % of Mn, and the balance of Al and impurities, and an alloy structure with a primary Si crystal size smaller than 80 microns, a Si-Mn-Fe compound grain size smaller than 120 microns, and an alpha-Al phase size smaller than 100 microns.

19 Claims, 3 Drawing Figures

(x50)

(x50)

(x50)

ABRASION RESISTANT ALUMINUM ALLOY

BACKGROUND OF THE INVENTION

1. Field of the Invention

This invention relates to wear resistant aluminum alloys, and more particularly to an aluminum alloy which is improved in extrudability, forgeability and mechanical properties.

2. Description of the Prior Art

Automobile mechanical parts, for example, sliding parts such as pistons and cylinders are required to be light in weight and wear resistant. In this regard, it has been proposed to employ eutectic and hyper-eutectic alloys of Al-Si as a material satisfying the just-mentioned requirements. However, the conventional alloys still have a number of problems as discussed below.

AA4032(eutectic alloy): Excellent in forgeability and extrudability but inferior in abrasion resistance and tensile strength.

A390(Alsil, hyper-eutectic alloy): Excellent in abrasion resistance but difficult to extrude and inferior in forgeability, tensile strength and fatigue strength.

In addition to these eutectic and hyper-eutectic alloys, Japanese Patent Publication Nos. 48-41407 and 49-22264 disclose aluminum alloys, which are however unsatisfactory in extrudability.

SUMMARY OF THE INVENTION

It is an object of the present invention to provide an aluminum alloy which can overcome the drawbacks or problems of the above-mentioned conventional aluminum alloys.

It is a more specific object of the invention to provide a wear resistant aluminum alloy which excels AA4032 in wear resistance and excels A390 in extrudability, forgeability and mechanical properties.

According to the invention, there is provided a wear resistant aluminum alloy characterized in that the aluminum alloy has a chemical composition essentially consisting of 7.5–15.0 wt% of Si, 3.0–6.0 wt% of Cu, 0.3–1.0 wt% of Mg, 0.25–1.0 wt% of Fe, 0.25–1.0 wt% of Mn, and the balance of Al and impurities, and an alloy structure with a primary Si crystal smaller than 80μ, a Si-Mn-Fe compound grain size smaller than 120μ, and an α-Al phase size smaller than 100μ.

As described in detail hereinlater, the wear resistant aluminum alloy of the present invention may further contain: 0.3–2 wt% of Ni; singly or jointly 0.05–0.4 wt% of Cr and 0.05–0.25 wt% of Zr; 0.001–0.05 wt% of Ti; and/or singly or in combination less than 0.5 wt% of B, less than 0.5 wt% of Mo, less than 0.5 wt% of Co, less than 0.5 wt% of Sb, less than 0.5 wt% of Nb, less than 0.5 wt% of Pb, less than 0.5 wt% of Bi, less than 0.5 wt% of V and less than 1 wt% of Zn.

BRIEF DESCRIPTION OF THE DRAWINGS

The above and other objects, features and advantages of the present invention will become apparent from the following description and appended claims, taken in conjunction with the accompanying drawings, in which

PARTICULAR DESCRIPTION OF THE INVENTION

Figure 1:
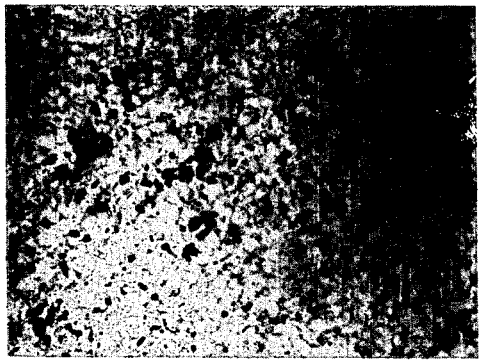
FIG. 1 is a microphotograph showing the metal structure of an ingot of a wear resistant aluminum alloy according to the present invention.

Firstly, description is directed to the alloy elements and their proportions in the wear resistant aluminum alloy according to the invention.

Si is an element which is essential for imparting the abrasion resistance, and its effect is insufficient if contained in an amount less than 7.5 wt%. If contained in excess of 15 wt%, it will produce a large quantity of primary crystal of Si, making the extrusion difficult and deteriorating the mechanical properties especially toughness and fatigue strength. Accordingly, the Si content should be in the range of 7.5 to 15.0 wt%.

The Si content is preferred to be in the range of 7.5 to 13.5 wt% in order to secure abrasion resistance higher than that of AA4032 along with forgeability comparable to the latter, and to be in the range of 11–13.5 wt% in order to secure abrasion resistance, mechanical properties and forgeability comparable to or higher than A390.

Cu is an element which contributes to improvements of mechanical properties and prevention of metal adhesion in addition to improvement of wear resistance. A Cu content less than 3.0 wt% is insufficient for producing its effects in these aspects, and a Cu content in excess of 6.0 wt% impairs the extrudability. Therefore, in order to secure necessary mechanical properties and abrasion resistance, the Cu content should be in the range of 3.0–6.0 wt%.

Nevertheless, the Cu content is preferred to be in the range of 3.8–4.6 wt% from the standpoint of securing superior mechanical properties and forgeability and equivalent wear resistance as compared with A390.

Mg is an element which contributes to the improvement of mechanical properties and to the impartment of abrasion resistance by production of Mg Si precipitate. These effects are produced insufficiently if its content is less than 0.3 wt%, and the extrudability and forgeability are impaired if Mg is contained in excess of 1.0 wt%. Consequently, the Mg content should be in the range of 0.3–1.0% which would not cause deteriorations in extrudability and forgeability.

The effects of Mg addition on the mechanical properties reach a maximum value at a content of 0.7 wt%, with drops in mechanical properties with a greater or smaller Mg content. Therefore, the most preferred range of the Mg content is 0.6–0.9 wt%.

The elements Fe and Mn have similar effects, namely, effects of accelerating production of fine eutectic Si and Si-base precipitates and improving wear resistance by producing Si-Mn-Fe base crystals. These effects are poor if their contents are less than 0.25 wt%, and, if contained in excess of 1.0 wt%, they deteriorate the forgeability and mechanical properties by producing primary compounds. Accordingly, Fe and Mn contents should be each in the range of 0.25–1.0 wt%.

Although gradually, the strength begins to drop as the Fe or Mn content is increased beyond 0.6 wt%, so that the most preferred ranges for the Fe and Mn contents are 0.4–0.7 wt%.

Ni is an element which contributes to impart heat resistance (high temperature strength) which is desired in a case where the wear resistant aluminum alloy of the invention is to be used under a high temperature condition above 250° C. This effect is poor if Ni contained in an amount less than 0.3 wt%, and an Ni content in excess of 2 wt% is uneconomical since its effect is saturated at that point. Further, the wear resistance is imparted by the Ni content. Namely, Ni imparts wear resistance by producing Al-Cu-Ni compounds of Hv1100 and $Al_3Ni$ compound of Hv770. This effect is also poor if the Ni content is smaller than 0.3 wt%, while the compounds are coasened if Ni is contained in excess of 2 wt%, losing the wear resistance improving effect.

If Si, Cu and Mg are in the most preferred ranges of 11–13.5 wt%, 3.8–4.6 wt% and 0.6–0.9 wt%, respectively, Ni crystallizes by forming compounds with Cu, lowering the amount of solid solution of Cu and thus lowering the strength at normal temperature. Accordingly, the additive amount of Ni is preferred to be in a range which would not lower the strength at normal temperature and which would improve the high temperature strength, namely, in the range of 0.5–1.3 wt%.

The aluminum alloy according to the invention may further contain Cr and/or Zr in a proportion as defined below.

Cr is an element which contributes to the impartment of the wear resistance by forming $CrAl_7$ compound of Hv510. This effect is insufficient if the Cr content is less than 0.05 wt%, and the extrudability and mechanical properties are lowered by production of primary compounds if contained in excess of 0.4 wt%. Accordingly, the Cr content should be in the range of 0.05–0.4 wt%.

Zr is an element which suppresses coarsensing of structures which are produced in the stages of extrusion and heat treatment. This effect is poor if the Zr content is less than 0.05 wt%, but a Zr content in excess of 0.25 wt% will invite formation of primary compounds, dropping the extrudability as well as mechanical properties. Therefore, the Zr content should be in the range of 0.05–0.25 wt%.

When Si, Cu and Mg are in the most preferred ranges of 11–13.5 wt%, 3.8–4.6 wt% and 0.6–0.9 wt%, respectively, the total amount of the additive alloy elements exceeds the limit of solid solubility in aluminum, creating a state which is apt to produce coarse compounds of Cr and Zr. For this reason, it is desirable to suppress the upper limits of the Cr and Zr contents. The preferred ranges of the Cr and Zr contents are 0.05–0.2 wt%.

Besides the above-mentioned alloy elements, the aluminum alloy of the invention may further contain singly or in combination B, Mo, Co, Sb, Nb, Pb, Bi, V each in an amount less than 0.5 wt% and Zn in amount less than 1 wt%.

The above-mentioned elements B, Mo, Co, Sb, Nb, Pb, Bi and V are all barely soluble in solid, so that, if contained in excess of 0.5 wt%, their compounds crystallize at grain boudaries, lowering the mechanical properties and forgeability. Accordingly, the additive amounts of B, Mo, Co, Sb, Nb, Pb, Bi and V should be less than 0.5 wt%.

The total amount of Si, Cu, Mg, Mn and Fe in the alloy according to the invention exceeds the limit of solid solubility in aluminum, so that addition of Zn in excess of 1 wt% would cause production of $MgZn_2$ in grain boundary regions and thus result in lower mechanical properties. The content of Zn is therefore preferred to be less than 1 wt%.

Ti is an element which is added to make the ingot structure finer and to stabilize the extrudability and mechanical properties of the extrudate. However, if contained in excess of 0.05 wt%, it will increase the amounts of crystallization products and rather lower the mechanical properties. Thus, the effective range of the Ti content is 0.001–0.05 wt%.

Further, according to the present invention, the wear resistance and mechanical properties are enhanced all the more by forming the aluminum alloy structure into a restricted metal structure having a primary crystal Si size smaller than 80 microns, a Si-Mn-Fe compound size smaller than 120 microns, and an alpha-Al phase size smaller than 100 microns.

If the primay Si crystal size exceeds 80 microns, the region of the alpha-Al phase which exists in such a manner as to wrap in the primary Si crystal is locally increased, and the primary Si crystal itself undergoes cracking in the extruding stage and easily comes off by frictional wear, thus lowering the wear resistance. Accordingly, the primary Si crystal size should be smaller than 80 microns.

If the Si-Mn-Fe compound size exceeds 120 microns, the compound itself undergoes cracking in the extruding stage and easily comes off by frictional wear, lowering the wear resistance. Consequently, it should be smaller than 120 microns.

The regions of the $\alpha$-Al phase are softer than those of the primary or eutectic Si or the Si-Mn-Fe compounds, so that, if the size of the $\alpha$-Al phase exceeds 100 microns, there will occur an increase of regions which are susceptible to abrasion wear, abruptly lowering the wear resistance. Therefore, the $\alpha$-Al phase size should be smaller than 100 microns.

Preferably, the sizes of the primary Si crystal and Si-Mn-Fe compounds are in the rages smaller than 70 microns and 100 microns, respectively. These preferred ranges are determined from a viewpoint of preventing cracks which would otherwise occur on the surface of extrudates in the extruding stage and maintaining the fatigue strength. If the sizes of the primary Si crystal and Si-Mn-Fe compounds exceed 70 microns and 100 microns, respectively, cracks occur to the intergranular surfaces between the aluminum matrix and these compounds in the extruding stage, impairing the productivity. In addition, the sizes of these compounds have an influence on the fatigue strength and cause a marked drop in the fatigue strength if exceed the above-defined ranges. For the purpose of maintaining the fatigue strength of the alloy, the Si-Mn-Fe compounds which are produced in a number less than that of the primary Si crystals suffice to be smaller than 100 microns, a greater size compared with the primary Si crystal which is limited to 70 microns.

In the manufacturing process of the aluminum alloy of the present invention, a homogenizing treatment and indirect extrusion are employed in the manner as discussed hereafter.

In a case where the alumium alloy of the invention is applied to automobile parts such as pistons, cylinders and the like, the alloy stock is suitably extruded from the standpoint of guaranteeing stability in the mechanical properties and obtaining forging materials of samll diameters stably. Although the alloy has inferior extrudabilty as compared with ordinary aluminum alloys, it has been found as a result of a research that the productivity of the alloy according to the invention can be enhanced by the use of indirect extrusion.

More particularly, aluminum alloy ingots of the above-defined composition are subjected to indirect extrusion after a soaking treatment for 2 hours or longer at a temperature of 400°–510° C.

This homogenizing treatment serves to improve the extrudability and forgeability by sphering the eutectic Si. A homogenizing temperature below 400° C. has a poor sphering effect on the eutectic Si, while a temperature above 510° C. will cause burning. The time of the homogenizing temperature can be shortened with a higher temperature, but it takes 2 hours or a longer time to sphere the eutectic Si in the above-mentioned temperature range. In consideration of the productivity and the sphering effect on the eutectic Si, it is preferred to effect the homogenizing treatment for a time period longer than 5 hours at a temperature of 470° C.–490° C.

Suitably, after hot-scalping the surfaces of a billet about 10 mm in a container, the billet is extruded at an extruding temperature of 270° C.–370° C. and with an extrusion ratio of or greater than 5.

In the indirect extrusion, it is possible to extrude a billet at a lower temperature as compared with the direct estrusion since no friction occurs between a billet and a container, and cracks hardly take place during the extrusion due to the reduction of shearing deformation regions.

The hot-scalping is important for removing defects on the surfaces or skin layers of the ingots to prevent cracking which would otherwise occur during extrusion. In the case of the alloy according to the invention, the ripples which take place in the surface layer as well as the inverse segregation layer and coarse cell layer which exist in the vicinity of the surface layer are removed by hot-scalping since they could lend themselves as a starting point of cracking in the extruding stage.

As mentioned hereinbefore, to prevent cracking during extrusion, the extruding temperature is held at a level which is lower than an ordinary extruding temperature. The lower limit of the extruding temperature is determined depending upon the press capacity and may be lower than 270° C.

The eutectic Si is finely divided by the extrusion-working. Althogh a higher extrusion ratio is desired from a viewpoint of making the eutectic Si finer, an extrusion ratio of 5 or higher can produce a sufficient effect in this regard.

Hereafer, the wear resistant aluminum alloy according to the present invention is illustrated more particularly by the following example.

EXAMPLE 1

Specimens Nos. 2–5, 10, 11, 14, 15, 18 and 20–24 of Table 1 are wear resistant aluminum alloys according to the invention, which were produced by adding 0.1 wt% of phosphorus in the smelting stage and casting at a cooling speed higher than 1.0° C./sec to reduce the sizes of the Si-Mn-Fe compounds and α-Al phase.

A microphotograph of the specimen Nos. 4 is shown in FIG. 1 as a typical example of the metal structure of the wear resistant aluminum alloy according to the invention. In FIG. 1, the primary Si crystals appear in black dots and the Si-Mn-Fe compounds appear in a light whitish color on a white background of the α-Al phase.

Figure 2:
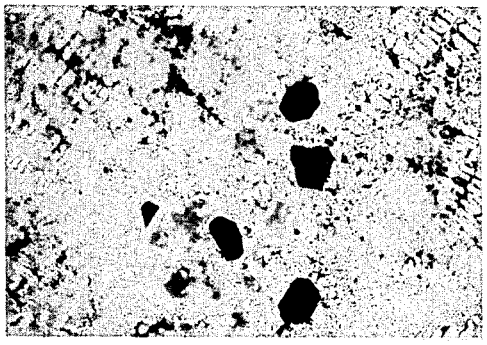
FIG. 2 is a microphotograph showing the metal structure of an ingot of a conventional aluminum alloy.

The specimen No. 25 which corresponds to the specimen No. 24, a wear resistant aluminum alloy according to the invention, shows large values especially in the sizes of the primary Si crystal, Si-Mn-Fe compounds and α-Al phase. This is because the specimen No. 25 was produced by smelting the alloy composition without adding phosphorus for the reduction of the primary Si crystal size and casting the smelt at a cooling speed lower than 0.5° C./sec. For comparision with the above-mentioned specimen No. 2, a microphotograph of a typical metal structure of the specimen No. 25 is shown in FIG. 2.

The thus obtained wear resistant aluminum alloy specimens Nos. 2–5, 10, 11, 14, 15, 18 and 20–24 according to the invention were comparred with the specimens Nos. 1, 6–9, 12, 13, 16, 17, 19 and 25 falling outside the sphere of the invention, by the follwing methods with regard to various properties. The results are shown in Table 1.

Extrudability: Tested by extruding 155 mmϕ billets into 27 mmϕ rods, indicating a billet extrudable at a speed higher than 5 m/min by a mark "O", a billet extrudable at a speed of 4 m/min to 2.5 m/min by a mark "Δ", and a billet extrudable at a lower speed by a mark "x".

Forgeability: Compared in terms of the maximum working rate which would not cause cracking when forging test strips of 10 mmϕ×20 mmh at 420° C.

Wear resistance: Tested by Ogoshi type abrasion tester at an abrasion speed of 0.1 m/sec under a load of 3.2 kg, and compared in terms of specific abrasion.

Tensile strength: Examined the specimens after soluditon treatment for 30 min. at 495° C., water-cooling and heat treatment of 170° C.×6 hrs.

Fatigue strength: Examined the specimens by way of rotational bending fatigue after the same heat treatment as in the tensile strength test.

As clear from Table 1, the wear resistant aluminum alloys of the present invention are superior to AA4032 alloy of the specimen No. 13 in abrasion resistance, and to Al-Si hyper-eutectic alloys of the specimens Nos. 6 to 8 in extrudability, forgeability and mechanical properties. Further, it will be understood that the restriction of the metal structure sizes is advantageous, from the superiority in mechanical properties and abrasion resistance of the specimen No. 4 of the invention having a primary Si crystal size of 50 microns (smaller than 80 microns), a Si-Mn-Fe compound size of 70 microns (smaller than 120 microns) and an α-Al phase size of 60 microns (smaller than 100 microns), to the specimen No. 25 which is greater in all of these sizes.

Figure 3:
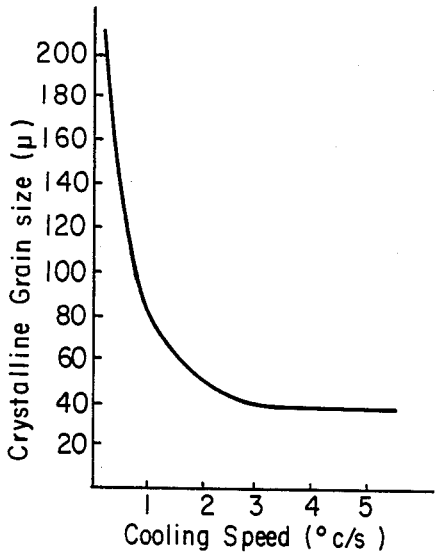
FIG. 3 is a diagram showing the relationship between the crystalline grain size and cooling speed.

FIG. 3 shows the influence which the cooling speed in the casting stage has on the crystallized grain size. Namely, in order to make the size of the Si-Mn-Fe compounds smaller than 120 microns, it is necessary to employ a cooling speed higher than 0.5° C./sec.

It will appreciated from the foregoing description that the abrasion resistant aluminum alloy of the invention has a particular construction as described hereinbefore and has excellent properties in wear resistance, extrudability, forgeability and mechanical properties.

Given below is an example of a method for producing the abrasion resistant aluminum alloy according to the present invention.

EXAMPLE 2

Aluminum alloys with chemical compositions as specified for the specimens Nos. 2 to 6 of Table 1 were smelted by an ordinary method to obtain ingots of 245 mmϕ×1000 mml.

After a homogenizing treatment for 8 hours at 470° C., the ingots thus obtained were extruded at a temperature of 330° C., comparing the highest extruding speeds at which the respective billets could be extruded without cracking. The results are shown in Table 2.

As seen in Table 2, the aluminum alloys produced by the method of the present invention could be extruded without cracking at a speed lower than 2 m/min in the case of 4-hole direct extrusion. However, in the case of indirect extrusion, crack-free extrusion was possible at a speed higher than 5.5 m/min for each specimen of the invention. The feasibility of 4-hole indirect extrusion means that the productivity can be increased by four times as high as that of the direct extrusion.

With the above-described method of the invention, it becomes possible to produce abrasion resistant aluminum alloys efficiently which have excellent properties not only in wear resistance but also in forgeability and mechanical properties.

TABLE 2

| Specimen No. | Method of Extrusion | 1-hole | 4-hole |
|---|---|---|---|
| 2* | Direct extrusion | 8.0 | 2.0 |
| | Indirect extrusion | 10.0 | 8 |
| 3* | Direct extrusion | 7.0 | 1.0 |
| | Indirect extrusion | 8.0 | 7.5 |
| 4* | Direct extrusion | 5.0 | <1.0 |
| | Indirect extrusion | 6.0 | 6.0 |
| 5* | Direct extrusion | 5.0 | <1.0 |
| | Indirect extrusion | 6.0 | 5.5 |
| 6 | Direct extrusion | 2.5 | <1 |
| | Indirect extrusion | 3.0 | 3.5 |

1. *Specimens according to the invention.
2. Figures in this table indicate the highest speed at which the extrusion was feasible without cracking.

What is claimed is:

TABLE 1

| Specimen No. | Chemical Composition (wt %) Si | Fe | Cu | Mn | Mg | Cr | Zn | Ti | Zr | Ni | Al | Primary Si crystal size (μ) | Si—Mn—Fe compound size (μ) | α-Al phase size (μ) | Extrudability |
|---|---|---|---|---|---|---|---|---|---|---|---|---|---|---|---|
| 1 | 4.0 | 0.5 | 4.3 | 0.6 | 0.7 | — | — | — | — | — | Balance | | | | o |
| *2 | 7.5 | 0.5 | 4.2 | 0.5 | 0.6 | — | — | — | — | — | " | | | | o |
| *3 | 10.0 | 0.5 | 4.1 | 0.6 | 0.7 | — | — | — | — | — | " | | | | o |
| *4 | 12.5 | 0.6 | 4.2 | 0.6 | 0.6 | — | — | — | — | — | " | 50 | 70 | 60 | o |
| *5 | 14.5 | 0.5 | 4.0 | 0.6 | 0.7 | — | — | — | — | — | " | | | | o |
| 6 | 17.0 | 0.2 | 4.5 | tr | 0.6 | — | — | — | — | — | " | | | | Δ |
| 7 | 22.0 | 0.2 | 4.3 | 0.2 | 0.6 | — | — | — | — | — | " | | | | x |
| 8 | 21.0 | 0.2 | 1.3 | tr | 1.0 | — | — | — | — | — | " | | | | x |
| 9 | 12.5 | 0.2 | 4.3 | tr | 0.6 | — | — | — | — | — | " | | | | o |
| *10 | 12.5 | 0.3 | 4.2 | 0.3 | 0.7 | — | — | — | — | — | " | | | | o |
| *11 | 12.5 | 1.0 | 4.3 | 1.0 | 0.6 | — | — | — | — | — | " | | | | o |
| 12 | 12.5 | 1.5 | 4.1 | 1.6 | 0.7 | — | — | — | — | — | " | | | | Δ |
| 13 | 12.0 | 0.5 | 1.0 | tr | 0.6 | — | — | — | — | 1.0 | " | | | | o |
| *14 | 12.0 | 0.6 | 3.0 | 0.6 | 0.6 | — | — | — | — | — | " | | | | o |
| *15 | 12.0 | 0.5 | 6.0 | 0.6 | 0.7 | — | — | — | — | — | " | | | | o |
| 16 | 12.5 | 0.5 | 7.5 | 0.5 | 0.7 | — | — | — | — | — | " | | | | Δ |
| 17 | 11.5 | 0.5 | 4.2 | 0.5 | 0.2 | — | — | — | — | — | " | | | | o |
| *18 | 11.0 | 0.5 | 4.3 | 0.5 | 1.0 | — | — | — | — | — | " | | | | o |
| 19 | 12.0 | 0.6 | 4.3 | 0.5 | 2.0 | — | — | — | — | — | " | | | | Δ |
| *20 | 12.5 | 0.5 | 4.3 | 0.5 | 0.6 | — | — | — | — | 1.5 | " | | | | o |
| *21 | 11.5 | 0.5 | 4.3 | 0.5 | 0.6 | 0.2 | — | — | — | — | " | | | | o |
| *22 | 11.5 | 0.45 | 4.3 | 0.45 | 0.6 | 0.15 | — | — | 0.15 | — | " | | | | o |
| *23 | 11.5 | 0.4 | 4.3 | 0.4 | 0.6 | 0.15 | — | — | 0.15 | 1.2 | " | | | | o |
| *24 | 11.3 | 0.5 | 4.3 | 0.5 | 0.6 | — | — | 0.02 | — | — | " | | | | o |
| 25 | 12.5 | 0.5 | 4.3 | 0.5 | 0.6 | | | | | | " | 150 | 160 | 140 | o |

| Specimen No. | Forgeability | Tensile strength (kg/mm) | Hardness (HV) | Wear resistance (specific abrasion) | Fatigue strength (kg/mm) |
|---|---|---|---|---|---|
| 1 | 65 | 40 | 160 | 20 | — |
| *2 | 60 | 44 | 166 | 8 | — |
| *3 | 55 | 45 | 166 | 6 | — |
| *4 | 54 | 47 | 175 | 5 | 16 |
| *5 | 50 | 43 | 175 | | — |
| 6 | 35 | 38 | 175 | 5 | 14 |
| 7 | 15 | 30 | 175 | 4.5 | 9 |
| 8 | 15 | 23 | 160 | 5 | — |
| 9 | 55 | 45 | 167 | 9 | — |
| *10 | 55 | 47 | 170 | 4.5 | — |
| *11 | 50 | 42 | 180 | 4.5 | — |
| 12 | 40 | 37 | 185 | 4.5 | — |
| 13 | 55 | 37 | 155 | 10.0 | — |
| *14 | 55 | 41 | 165 | 7 | — |
| *15 | 50 | 45 | 183 | 4.5 | — |
| 16 | 40 | 40 | 185 | 4.0 | — |
| 17 | 55 | 40 | 165 | 7 | — |
| *18 | 50 | 46 | 175 | 5 | — |
| 19 | 35 | 44 | 175 | 5 | — |
| *20 | 45 | 46 | 180 | 4.5 | — |
| *21 | 50 | 46 | 180 | 4.5 | — |
| *22 | 50 | 46 | 180 | 4.5 | — |
| *23 | 45 | 45 | 180 | 4.5 | — |
| *24 | 55 | 47 | 175 | 5 | — |
| 25 | 45 | 40 | 170 | 7 | 13 |

*Specimens according to the invention.

1. An abrasion resistant aluminum alloy consisting of 7.5–15 wt. % of Si, 3.0–6.0 wt. % of Cu, 0.3–1.0 wt. % of Mg, 0.25–1.0% of Fe, 0.25–1.0 wt. % of Mn and 0.05–0.4 wt. % of Cr or 0.05–0.25 wt. % of Zr or a mixture of said Cr and said Zr, with the balance being Al and impurities, and having an alloy structure with a primary Si crystal size smaller than 80 microns, a Si-Mn-Fe compound grain size of smaller than 120 microns, and an α-Al phase size of smaller than 100 microns.

2. An abrasion resistant aluminum alloy consisting of 7.5–15 wt. % of Si, 3.0–6.0 wt. % of Cu, 0.3–1.0 wt. % of Mg, 0.25–1.0% of Fe, 0.25–1.0 wt. % of Mn and 0.001– 0.05 wt. % of Ti, with the balance being Al and impurities, and having an alloy structure with a primary Si crystal size of smaller than 80 microns, a Si-Mn-Fe compound grain size of smaller than 120 microns, and an α-Al phase size of smaller than 100 microns.

3. An abrasion resistant aluminum alloy consisting of 7.5–15 wt. % of Si, 3.0–6.0 wt. % of Cu, 0.3–1.0 wt. % of Mg, 0.25–1.0% of Fe, 0.25–1.0 wt. % of Mn, and at least one element selected from the group consisting of less than 0.5 wt. % of B, less than 0.5 wt. % of Mo, less than 0.5 wt. % of Co, less than 0.5 wt. % of Sb, less than 0.5 wt. % of Nb, less than 0.5 wt. % of Pb, less than 0.5 wt. % of Bi, less than 0.5 wt. % of V and less than 1 wt. % of Zn, with the balance being Al and impurities, and having an alloy structure with a primary Si crystal size smaller than 80 microns, a Si-Mn-Fe compound grain size of smaller than 120 microns, and α-Al phase size of smaller than 100 microns.

4. The abrasion resistant aluminum alloy of claim 1, wherein said aluminum alloy is produced by subjecting an aluminum alloy ingot to a homogenizing treatment for more than 2 hours at 400°–510° C., followed by indirect extrusion.

5. The abrasion resistant aluminum alloy of claim 1, wherein said alloy structure has a primary Si crystal size smaller than 70 microns.

6. The abrasion resistant aluminum alloy of claim 1, wherein said alloy structure has a Si-Mn-Fe compound grain size smaller than 100 microns.

7. The abrasion resistant aluminum alloy of claim 1, wherein Si is contained in the range of 7.5–13.5 wt%.

8. The abrasion resistant aluminum alloy of claim 7, wherein Si is contained in the range of 11–13.5 wt%.

9. The abrasion resistant aluminum alloy of claim 1, wherein Cu is contained in the range of 3.8–4.6 wt%.

10. The abrasion resistant aluminum alloy of claim 1, wherein Mg is contained in the range of 0.6–0.9 wt%.

11. The abrasion resistant aluminum alloy of claim 1, wherein Fe is contained in the range of 0.4–0.7 wt%.

12. The abrasion resistant aluminum alloy of claim 1, wherein Mn is contained in the range of 0.4–0.7 wt%.

13. The abrasion resistant aluminum alloy of claim 1, wherein Cr is contained in the range of 0.05–0.2 wt%.

14. The abrasion resistant aluminum alloy of claim 1, wherein Zr is contained in the range of 0.05–0.2 wt%.

15. The abrasion resistant aluminum alloy of claim 4, wherein the temperature of said homogenizing treatment is 470°–490° C.

16. The abrasion resistant aluminum alloy of claim 4, wherein the time of said homogenizing treatment is longer than 5 hours.

17. The abrasion resistant aluminum alloy of claim 4, wherein the temperature of said indirect extrusion is lower than 370° C.

18. The abrasion resistant aluminum alloy of claim 17, wherein the temperature of said indirect extrusion is in the range of 270°–370° C.

19. The abrasion resistant aluminum alloy of claim 4, wherein the extrusion ratio of said indirect extrusion is greater than 5.

* * * * *